US005938459A

United States Patent [19]

Lee et al.

[11] Patent Number: 5,938,459

[45] Date of Patent: Aug. 17, 1999

[54] ELECTRIC PLUG PLATE

[76] Inventors: Chiu-Shan Lee; S. S. Chen Li, both of No. 23, Lane 19, Chang-Chun Rd., Hsintien, Taiwan

[21] Appl. No.: 09/004,309

[22] Filed: Jan. 8, 1998

[51] Int. Cl.[6] ..... H01R 29/00

[52] U.S. Cl. ..... 439/172; 439/518; 439/693

[58] Field of Search ..... 439/172, 173, 439/177, 52, 518, 693

[56] References Cited

U.S. PATENT DOCUMENTS

| | | | |
|---|---|---|---|
| 4,973,827 | 11/1990 | Nozaki | 439/173 |
| 5,613,863 | 3/1997 | Klaus et al. | 439/173 |
| 5,848,907 | 12/1998 | Chen | 439/172 |
| 5,851,123 | 12/1998 | Chou | 439/172 |

*Primary Examiner*—Neil Abrams
*Assistant Examiner*—T C Patel
*Attorney, Agent, or Firm*—Rosenberg, Klein & Bilker

[57] ABSTRACT

An electric plug plate having two symmetrical power blade mounting zones and a grounding prong mounting zone between the power blade mounting zones, a plurality of power blade mounting holes and grounding prong mounting holes respectively disposed at the power blade mounting zones and grounding prong mounting zone, two first metal mounting plates and a second metal mounting plate respectively mounted in respective back recesses thereof and having threaded power blade mounting holes or grounding prong mounting holes corresponding to the power blade mounting holes and grounding prong mounting holes at the power blade mounting zones and grounding prong mounting zone for mounting a pair of metal contact blades and a grounding prong subject to one of a variety of electric plug specifications.

11 Claims, 10 Drawing Sheets

| CODE | APPLICATION AREA | SPECIFICATION |
|---|---|---|
| A | British standards:South Africa | 15A250V |
| B | British standards:HK, Malaysia, Uganda, Singapore, Arabian countries | 13A250V |
| C | British colonies, India | 5A250V<br>15A250V |
| D | China, New Zealand, Australia | 10A250V |
| E | Denmark | 15A250V |
| F | Middle East | 15A250V |
| G | Middle East | 15A250V |
| H | American standards:Taiwan, Japan, USA, Canada, Cuba, Venezuela, Costa Rica, Guam Dominique, Ecudor, Hawaii, Salvador, Haiti, Honduras, Maxico, Panama, Nicalagua<br><br>Philippines, Thanland, Guatemala, Paragua | 125V<br><br>250V |
| I | Taiwan, Japan, USA, Canada | 20A250V |
| J | Taiwan, Japan, USA, Canada | 15A250V |
| K | China | |
| L | Italy | 10-16A250V |
| M | Swiss | 10-16A250V |
| N | Taiwan, Japan, USA, Canada<br>China, Philippines, Tailand | 15A125V<br>250V |
| O | China, New Zealand, Australia | 250V |
| P | Russia, Europe | small electric home appliance 250V |
| Q,S,T | German, Europe(with side grounding) | 10-16A250V |
| R | Conventional British and Hong Kong Types | 250V |
| U | Electric plug for computer | |

FIG.5A

ELECTRIC PLUG PLATE

BACKGROUND OF THE INVENTION

The present invention relates to electric plug plates, and more specifically to such an electric plug plate which has symmetrical sets of power blade mounting holes and a set of grounding prong mounting hole for mounting a pair of metal contact blade and a grounding prong subject to one of a variety of electric plug specifications.

In different countries, different specifications are defined on electric devices. To an international electric device manufacturer, it is not economic to manufacture an electric device subject to different specifications. In order to reduce the manufacturing cost of for example an electric plug, a specification design on the electric plug plate is necessary for mounting metal contact blades and grounding prong at different locations to fit different specifications.

SUMMARY OF THE INVENTION

It is the main object of the present invention to provide an electric plug plate which can be alternatively mounted with different metal contact blades and grounding prongs to fit any of a variety of electric plug specifications for different countries. According to the present invention, the electric plug plate comprises a front side, a back side, two symmetrical power blade mounting zones bilaterally disposed at the front side, a plurality of power blade mounting recesses symmetrically spaced within the power blade mounting zones, a plurality of power blade mounting holes respectively disposed at the power blade mounting recesses, two symmetrical first back recesses bilaterally disposed at the back side corresponding to the symmetrical power blade mounting zones, two first metal mounting plates respectively mounted in the first back recesses in a flush manner, the first metal mounting plates each comprising a plurality of power blade mounting recesses respectively disposed corresponding to the power blade mounting recesses on the power blade mounting zones and a plurality of power blade mounting holes respectively disposed at the power blade mounting recesses corresponding to the power blade mounting holes on the power blade mounting zones for mounting a pair of metal contact blades subject to one of a set of electric plug specifications, a grounding prong mounting zone at the front side on the middle between the power blade mounting zones, a plurality of grounding prong mounting recesses respectively disposed within the grounding prong mounting zone, a plurality of grounding prong mounting holes respectively disposed at said grounding prong mounting recesses, a second back recess disposed at the back side corresponding to the grounding prong mounting zone, a second metal mounting plate mounted in the second back recess in a flush manner, the second metal mounting plate comprising a plurality of grounding prong mounting recesses corresponding to the grounding prong mounting recesses at the grounding prong mounting zone and a plurality of grounding prong mounting holes respectively disposed corresponding to the grounding prong mounting holes at the grounding prong mounting zone for mounting a grounding prong subject to one of a set of electric plug specifications, a plurality of mounting grooves adapted for mounting one of a set of electric plug members, a plurality of retaining holes respectively disposed around the mounting grooves for mounting hooks of an electric plug members, three computer plug mounting recesses at the front side near the bottom, three computer plug mounting holes respectively disposed at said computer plug mounting recesses and adapted for mounting a computer plug member.

FIGS. from 3 to 4E different made contact blade and grounding prong mounting examples according to the present invention.

Figure 5:
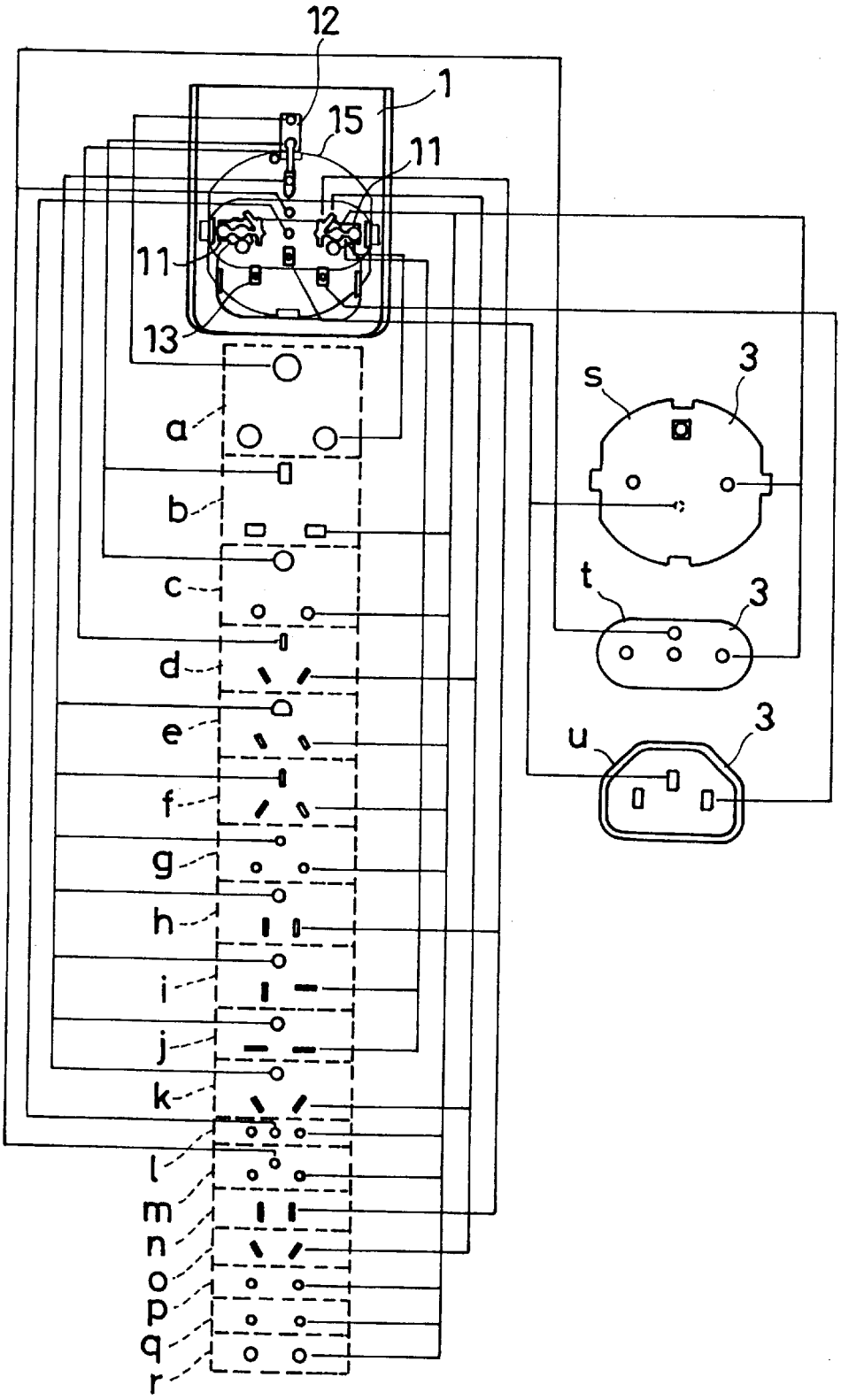

FIG. 5 is a schematic drawing showing the power blade mounting holes and grounding prong mounting holes made according to different electric plug specifications.

FIG. 5A shows different electric plug specifications used in different countries.

FIGS. from 6 to 6D show different metal contact blade and grounding prong mounting examples according to the present invention.

Figure 7:
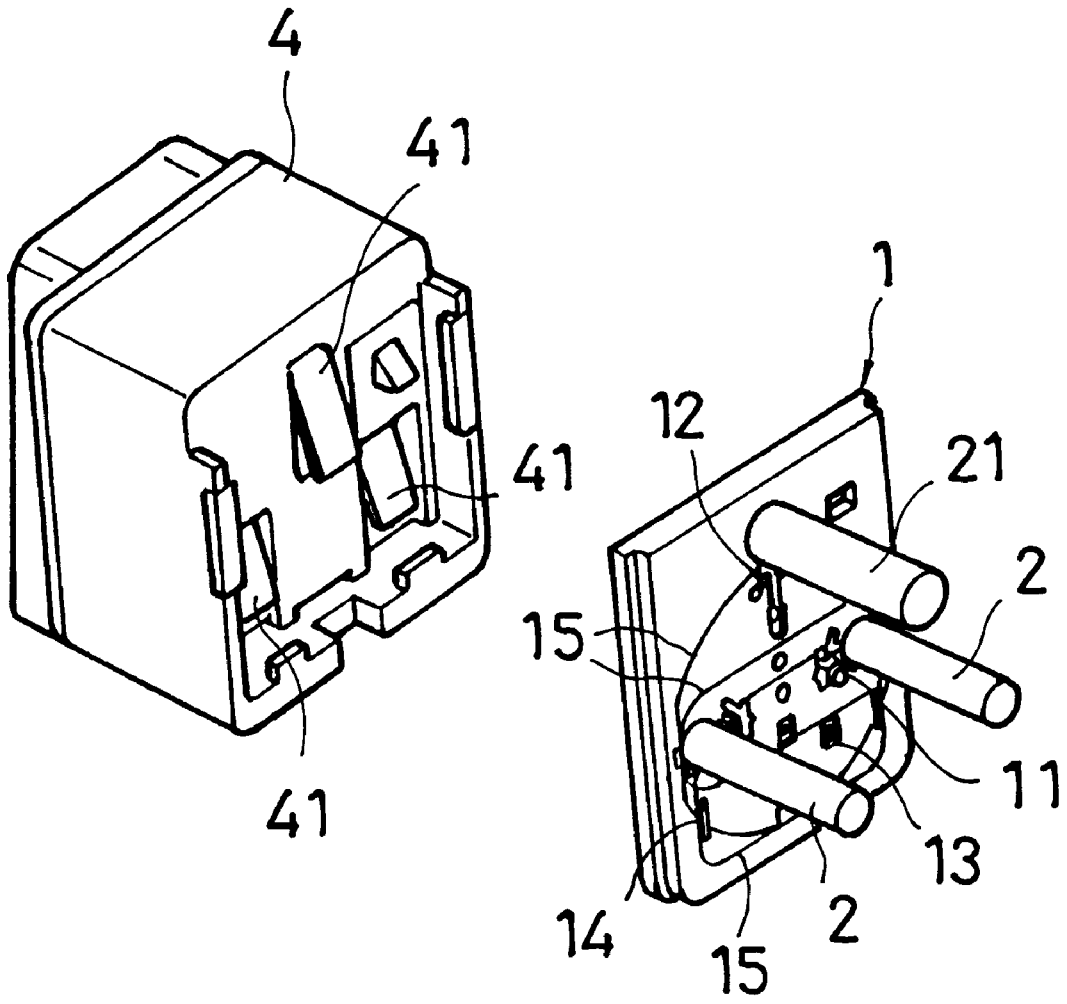

FIG. 7 shows an application example of the present invention for use with an electric socket.

DETAILED DESCRIPTION OF THE PREFERRED EMBODIMENT

Figure 1:
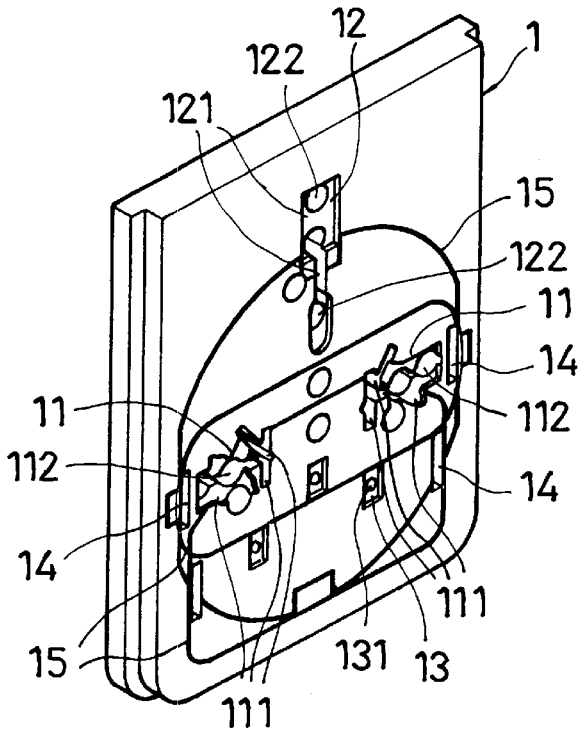
FIG. 1 is a perspective view of an electric plug plate according to the present invention.
Figure 2:
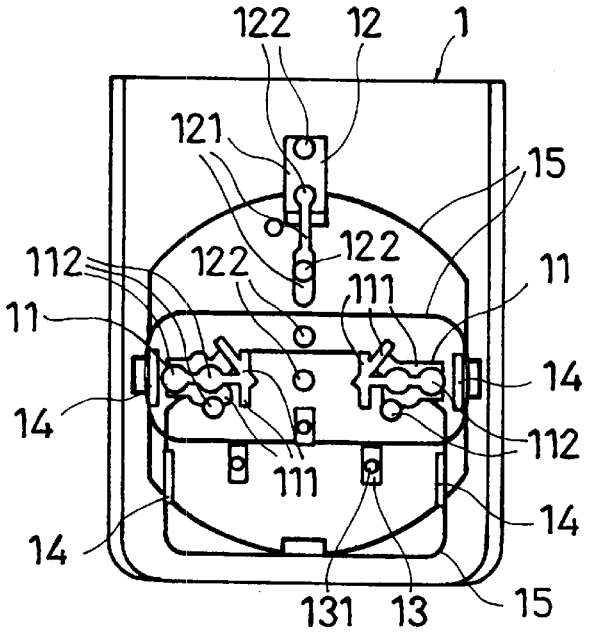
FIG. 2 is a front plain view of the electric plug plate shown in FIG. 1.
Figure 1A:
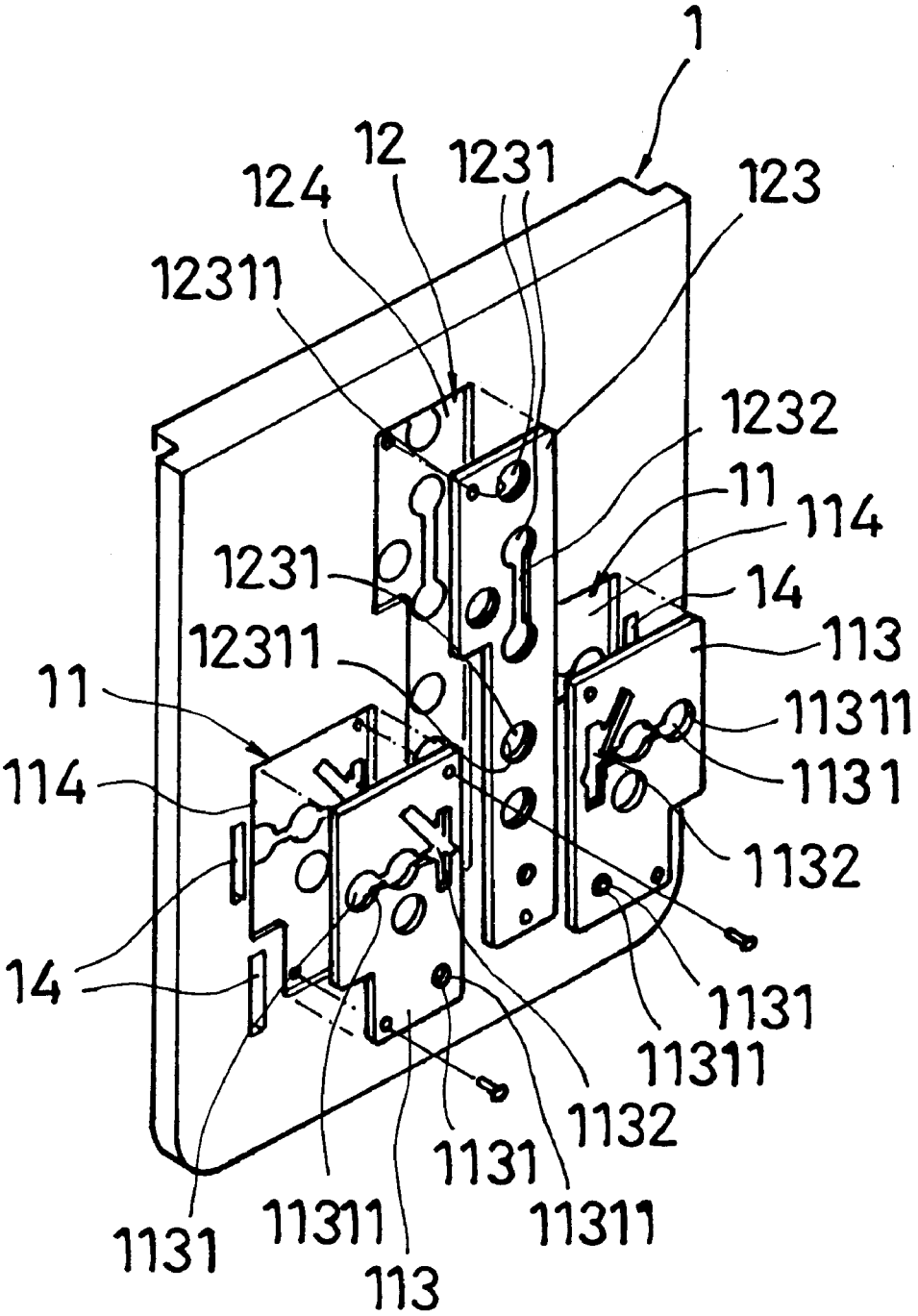
FIG. 1A is an exploded view of the electric plug plate shown in FIG. 1.
Figure 3:
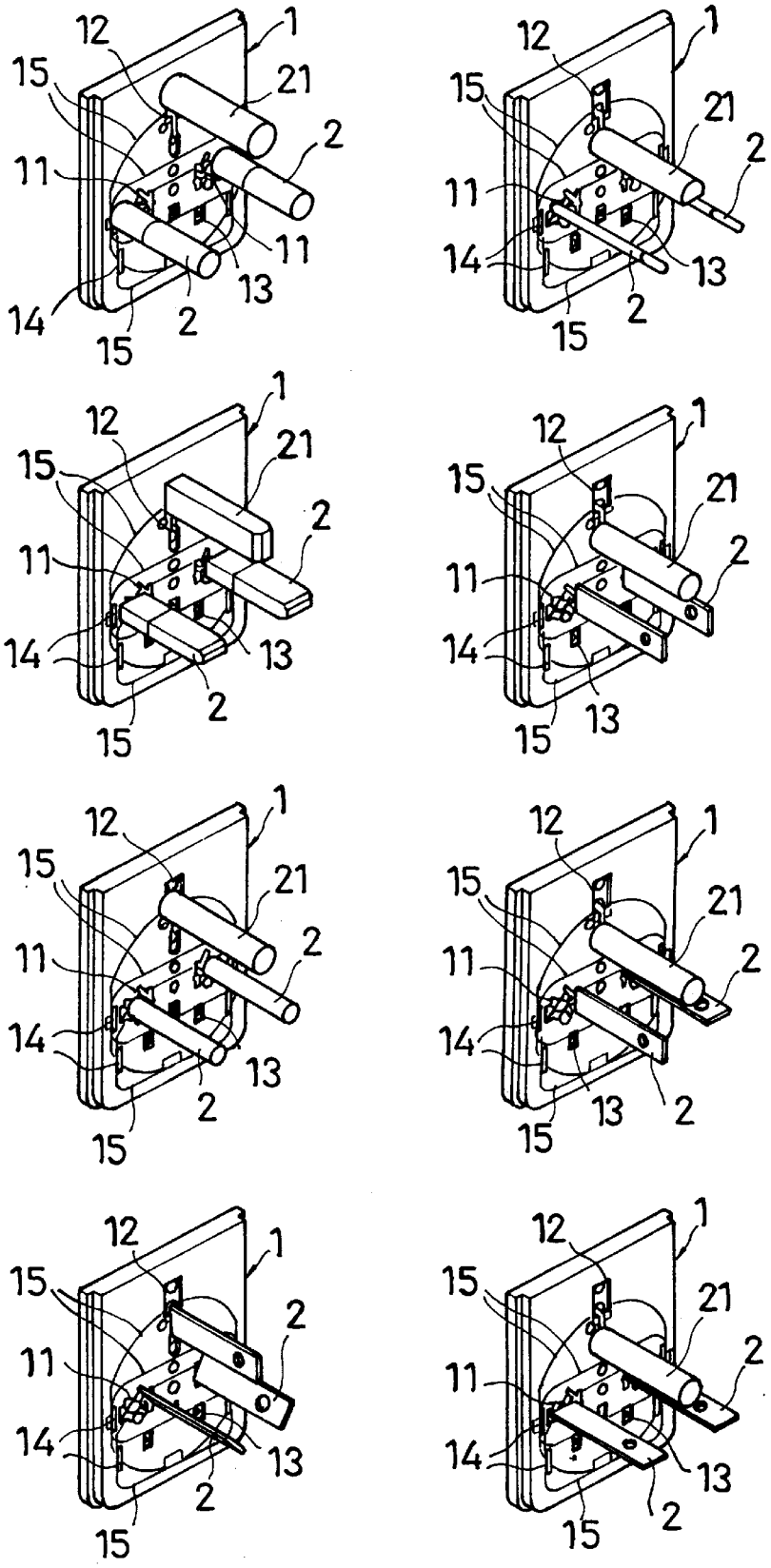
Figure 4:
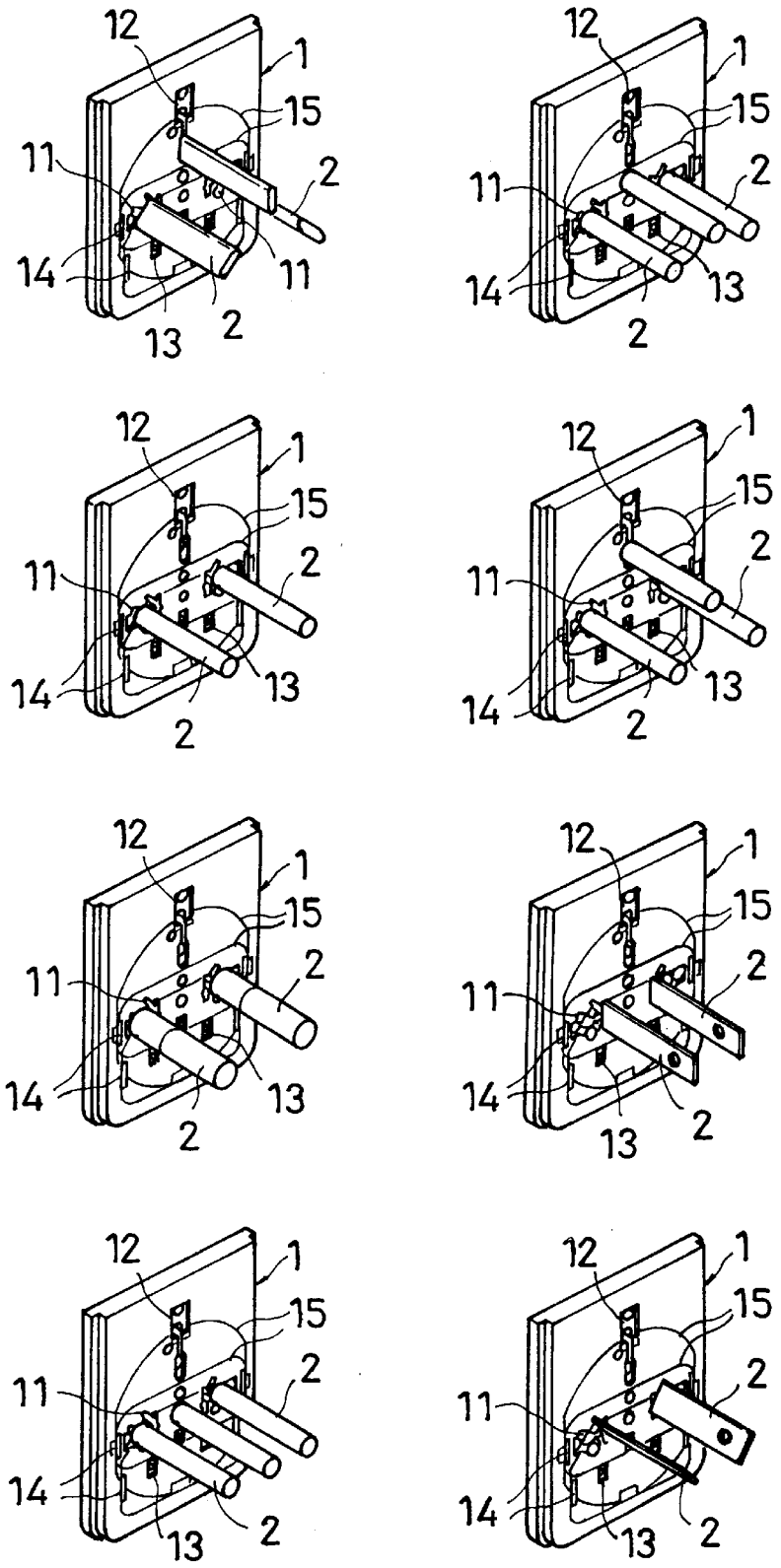
Figure 4A:
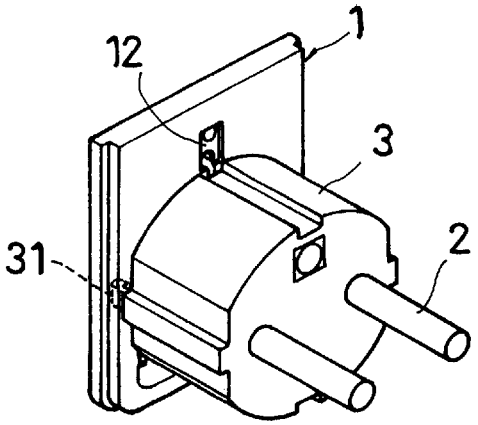
Figure 4B:
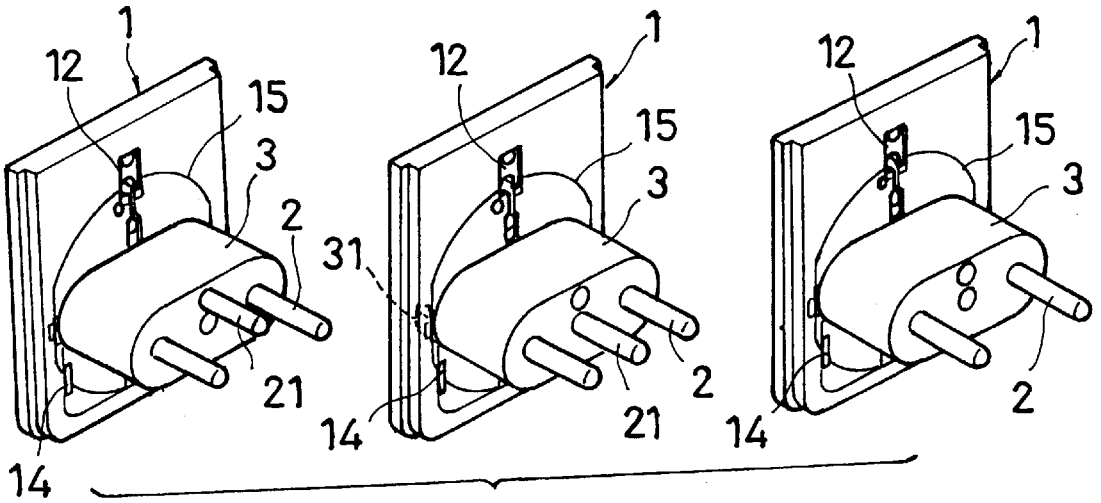
Figure 4C:
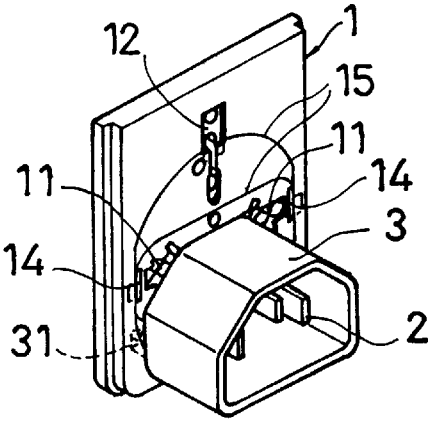

Referring to FIGS. from 1 to 5, an electric plug plate 1 in accordance with the present invention comprises two symmetrical power blade mounting zones 11 bilaterally disposed at the front side, a plurality of power blade mounting recesses 111 symmetrically spaced within the power blade mounting zones 11, a plurality of power blade mounting holes 112 respectively disposed at the power blade mounting recesses 111, two symmetrical first back recesses 114 bilaterally disposed at the back side corresponding to the symmetrical power blade mounting zones 11, two first metal mounting plates 113 respectively mounted in the first back recesses 114 in a flush manner, each first metal mounting plate 113 comprising a plurality of power blade mounting recesses 1132 respectively disposed corresponding to the power blade mounting recesses 111 on the power blade mounting zones 11 and a plurality of power blade mounting holes 1131 respectively disposed at the power blade mounting recesses 1132 corresponding to the power blade mounting holes 112 on the power blade mounting zones 11 for mounting a pair of metal contact blades 2 subject to one of a variety of electric plug specifications, each power blade mounting hole 1131 having an inner thread 11311, a grounding prong mounting zone 12 at the front side on the middle between the power blade mounting zones 11, a plurality of grounding prong mounting recesses 121 respectively disposed within the grounding prong mounting zone 12, a plurality of grounding prong mounting holes 122 respectively disposed at the grounding prong mounting recesses 121, a second back recess 124 disposed at the back side corresponding to the grounding prong mounting zone 12, a second metal mounting plate 123 mounted in the second back recess 124 in a flush manner, the second metal mounting plate 123 comprising a plurality of grounding prong mounting recesses 1232 corresponding to the grounding prong mounting recesses 121 at the grounding prong mounting zone 12 and a plurality of grounding prong mounting holes 1231 respectively disposed at the grounding prong mounting recesses 1232 corresponding to the grounding prong mounting holes 122 at the grounding prong mounting zone 12 for mounting a grounding prong 21 subject to one of a variety of electric plug specifications, each grounding prong mounting hole 1231 having an inner thread 12311, a plurality of mounting grooves 15 adapted for mounting one of a variety of electric plug members 3 (see FIGS. 4A and 4B, 5 and 5A), a plurality of retaining holes 14 respectively disposed around the mounting grooves 15 for mounting the hooks 31 on the electric plug members 3, three computer plug mounting recesses 13 at the front side near the bottom, three computer plug mounting holes 131 respectively disposed at the computer plug mounting recesses 13 and adapted for mounting a computer plug member 3 (see FIG. 4C). Different metal contact blades 2 and grounding prongs 21 may be selectively mounted in the power blade mounting holes 112;1131 and the grounding prong holes 121;1231 to fit one of a variety of electric plug specifications.

Figure 4D:
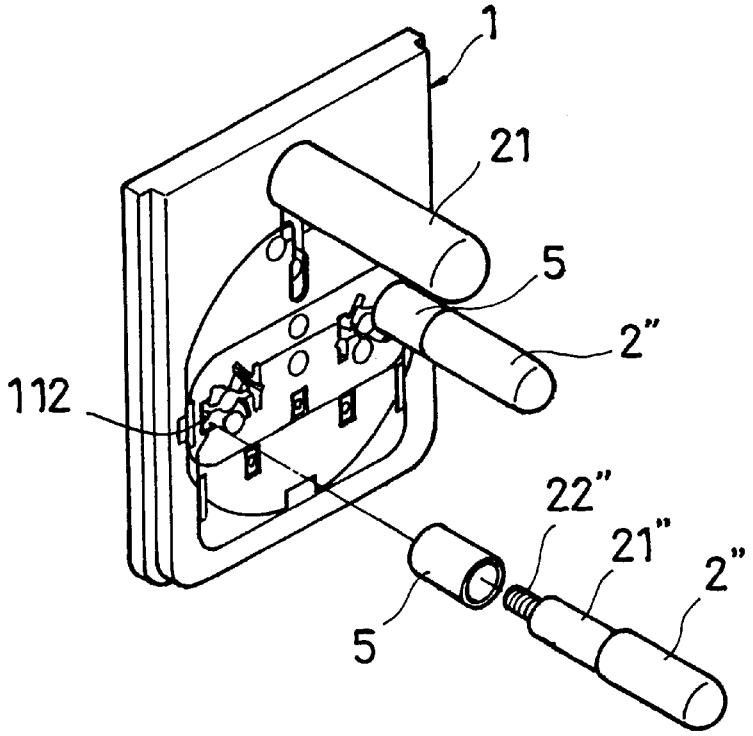

Referring to FIG. 4D, the rounded metal contact blade 2" comprises a front neck 21" sleeved with an electrically insulative jacket 5', and a front extension screw rod 22" axially extended from the front neck 21". The front extension screw rod 22" is inserted through one power blade mounting hole 112 on the electric plug plate 1, and then threaded into the inner thread 11311 in one power blade mounting hole 1131 on one first metal mounting plates 113.

Figure 4E:
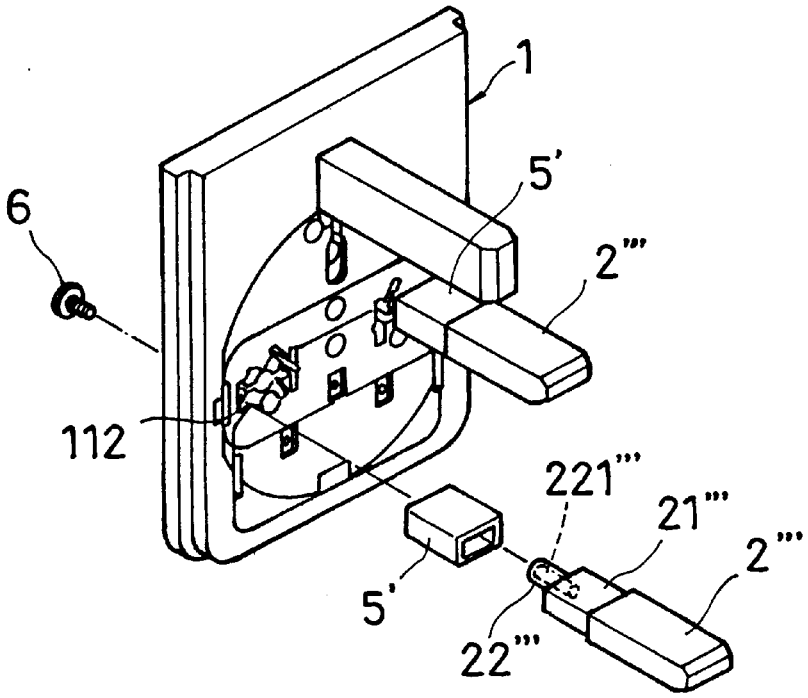

Referring to FIG. 4E, the flat metal contact blade 2'" comprises a front neck 21'" sleeved with an electrically insulated jacket 5', and a front extension screw rod 22'" axially extended from the front neck 21'". The front extension screw rod 22'" defines an axial screw hole 221'". The front extension screw rod 22'" is inserted through one power blade mounting hole 112 on the electric plug plate 1 and one power blade mounting hole 1131 on one first metal mounting plates 113, and then secured in place by threading a screw 6 into the axial screw hole 221'" on the front extension screw rod 22'".

Figure 6:
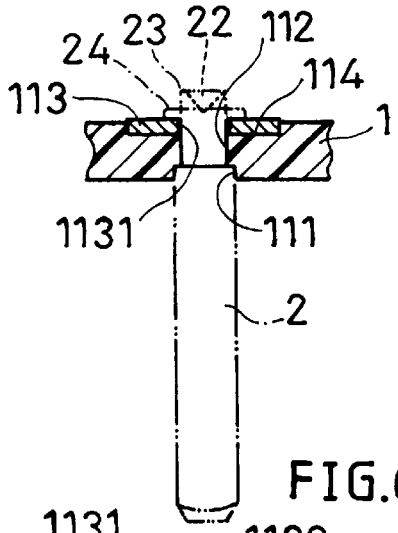

Referring to FIGS. 6 and 7, the round metal contact blade 2 has a hollow front end 22 inserted through one power blade mounting hole 112 on the electric plug plate 1 and one power blade mounting hole 1131 on one first metal mounting plates 113, and then the edge 23 of the hollow front end 22 is hammered down to form an electric contact 24 for connection to one metal contact plate 41 at the back side of the electric socket 4 (see FIG. 7).

Figure 6C:
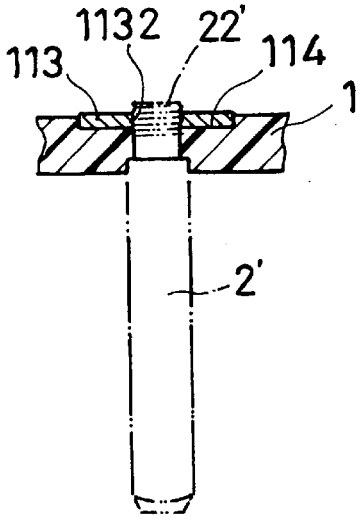
Figure 6A:
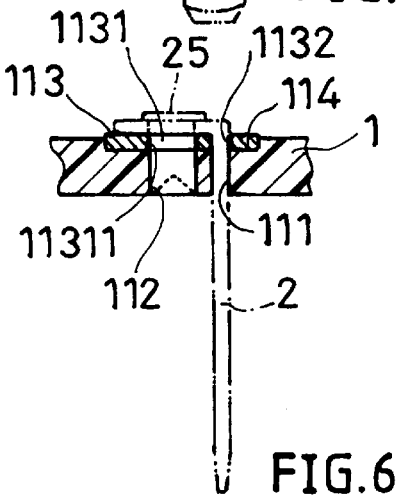

Referring to FIGS. 6A and 7, the flat metal contact blade 2 has a substantially L-shaped profile inserted through one power blade mounting hole 112 on the electric plug plate 1 and one power blade mounting hole 1131 on one first metal mounting plates 113, and then secured in place by a metal rivet 25. The metal rivet 25 serves as an electric contact for connection to one metal contact plate at the back side of the electric socket 4 (see FIG. 7).

Figure 6B:
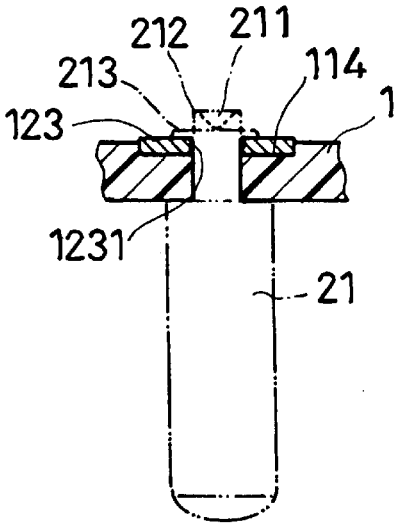

Referring to FIGS. 6B and 7, the round grounding prong 21 has a hollow front end 211 inserted through one grounding prong mounting hole 122 on the electric plug plate 1 and one grounding prong mounting hole 1231 on the second metal mounting plates 123, and then the edge 212 of the hollow front end 211 is hammered down to form an electric contact 213 for connection to one metal contact plate 41 at the back side of the electric socket 4 (see FIG. 7).

Figure 6D:
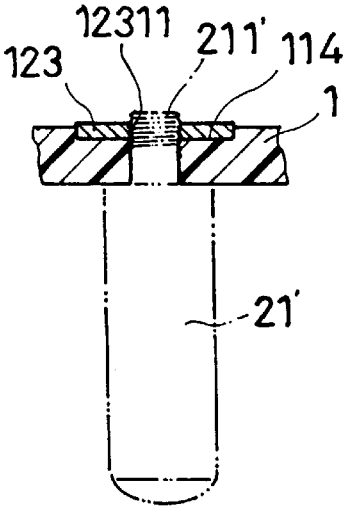

Referring to FIGS. 6C, 6D and 7, the round metal contact blade 2' or grounding prong 21' has a threaded end 22' or 211' inserted through one power blade mounting hole 112 or grounding prong mounting hole 122 on the electric plug plate 1 and then threaded into the inner thread 11311 or 12311 of one grounding prong mounting hole 1131 or 1231 on one first metal mounting plate 113 or the second metal mounting plates 123 for connection to the corresponding metal contact plates 41 at the back side of the electric socket 4 (see FIG. 7).

It is to be understood that the drawings are designed for purposes of illustration only, and are not intended as a definition of the limits and scope of the invention disclosed.

What the invention claimed is:

1. An electric plug plate comprising a front side, a back side, two symmetrical power blade mounting zones bilaterally disposed at the front side, a plurality of power blade mounting recesses symmetrically spaced within said power blade mounting zones, a plurality of power blade mounting holes respectively disposed at said power blade mounting recesses, two symmetrical first back recesses bilaterally disposed at the back side corresponding to said symmetrical power blade mounting zones, two first metal mounting plates respectively mounted in said first back recesses in a flush manner, said first metal mounting plates each comprising a plurality of power blade mounting recesses respectively disposed corresponding to the power blade mounting recesses on said power blade mounting zones and a plurality of power blade mounting holes respectively disposed at said power blade mounting recesses corresponding to the power blade mounting holes on said power blade mounting zones for mounting a pair of metal contact blades, a grounding prong mounting zone at the front side on the middle between said power blade mounting zones, a plurality of grounding prong mounting recesses respectively disposed within said grounding prong mounting zone, a plurality of grounding prong mounting holes respectively disposed at said grounding prong mounting recesses, a second back recess disposed at the back side corresponding to said grounding prong mounting zone, a second metal mounting plate mounted in said second back recess in a flush manner, said second metal mounting plate comprising a plurality of grounding prong mounting recesses corresponding to the grounding prong mounting recesses at said grounding prong mounting zone and a plurality of grounding prong mounting holes respectively disposed corresponding to the grounding prong mounting holes at said grounding prong mounting zone for mounting a grounding prong, a plurality of mounting grooves adapted for mounting one of a set of electric plug members, a plurality of retaining holes respectively disposed around said mounting grooves for mounting hooks of an electric plug members, three computer plug mounting recesses at the front side near the bottom, three computer plug mounting holes respectively disposed at said computer plug mounting recesses and adapted for mounting a computer plug member.

2. The electric plug plate of claim 1 further comprising a pair of metal contact blades respectively mounted in the power blade mounting holes at said power blade mounting zones and the power blade mounting holes at said first metal mounting plates.

3. The electric plug plate of claim 2 further comprising a grounding prong mounted in one grounding prong mounting hole at said grounding prong mounting zone and one grounding prong mounting hole at said second metal mounting plate.

4. The electric plug plate of claim 3, wherein each power blade mounting hole at each of said first metal mounting plate has an inner thread; each of said metal contact blades has a threaded front end threaded into the inner thread on one power blade mounting hole at one first metal mounting plate.

5. The electric plug plate of claim 4, wherein each of said metal contact blade has a neck, and an electrically insulative jacket mounted around said neck and stopped at the front side of the electric plug plate.

6. The electric plug plate of claim 3, wherein each grounding prong mounting hole at said second metal mounting plate has an inner thread; said grounding prong has a threaded front end threaded into the inner thread on one grounding prong mounting hole at said second metal mounting plate.

7. The electric plug plate of claim 6, wherein said grounding prong has a neck, and an electrically insulative jacket mounted around said neck and stopped at the front side of the electric plug plate.

8. The electric plug plate of claim 3, wherein each of said metal contact blades has a hollow front end inserted through one power blade mounting hole at one power blade mounting zone and one power blade mounting hole at one first metal mounting plate, and then hammered down to form an electric contact at the back side of the electric plug.

9. The electric plug plate of claim 3, wherein each of said metal contact blades has a front extension female screw rod inserted through one power blade mounting hole at one power blade mounting zone and one power blade mounting hole at one first metal mounting plate and then screwed up with a screw.

10. The electric plug plate of claim 3, wherein said grounding prong has a hollow front end inserted through one grounding prong mounting hole at said grounding prong mounting zone and one grounding prong mounting hole at said second metal mounting plate, and then hammered down to form an electric contact at the back side of the electric plug plate.

11. The electric plug plate of claim 3, wherein said grounding prong has a front extension female screw rod inserted through one grounding prong mounting hole at said grounding prong mounting zone and one grounding prong mounting hole at said second metal mounting plate and then screwed up with a screw.

* * * * *